US006655780B2

(12) United States Patent
Kimura

(10) Patent No.: US 6,655,780 B2
(45) Date of Patent: Dec. 2, 2003

(54) CLEANING CONTROL METHOD FOR RECORDING HEAD, CLEANING CONTROLLER PERFORMING THE METHOD, AND RECORDER INCORPORATING THE CLEANING CONTROLLER

(75) Inventor: Masahiro Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 09/942,031

(22) Filed: Aug. 30, 2001

(65) Prior Publication Data

US 2002/0035445 A1 Mar. 21, 2002

(30) Foreign Application Priority Data

Aug. 30, 2000 (JP) ..... P.2000-260588
Aug. 8, 2001 (JP) ..... P.2001-240103

(51) Int. Cl.[7] ..... B41J 2/165
(52) U.S. Cl. ..... 347/23
(58) Field of Search ..... 347/23, 14, 5, 347/29, 33, 30, 35; 358/1.16, 296

(56) References Cited

FOREIGN PATENT DOCUMENTS

| | | |
|---|---|---|
| EP | 0 810 509 A1 | 12/1997 |
| EP | 0 962 322 A1 | 12/1999 |
| JP | 9-267469 | 10/1997 |
| JP | 11-129487 | 5/1999 |
| JP | 11-192728 | 7/1999 |
| JP | 2001-138602 | 5/2001 |

OTHER PUBLICATIONS

EP 01 12 0650, Dec. 14, 2001, Van Oorschot, J, European Search report.

*Primary Examiner*—Shih Wen Hsieh
(74) *Attorney, Agent, or Firm*—Sughrue Mion, PLLC

(57) ABSTRACT

In a cleaning controller for a recording head of a recorder connected to an external device, a timer acquires a first time value indicating a current time from the external device, and performs cyclic clocking in which a first predetermined time period is repetitively clocked from a predetermined time point. A nonvolatile storage medium stores a second time value indicating a time at which a cleaning operation is lastly performed. A determinant compares the first and the second time values to obtain a third time value, and determines whether a cleaning operation is necessary to be performed based on the third time value. A cleaner performs a cleaning operation of the recording head based on the result determined by the determinant.

29 Claims, 9 Drawing Sheets

CLEANING CONTROL METHOD FOR RECORDING HEAD, CLEANING CONTROLLER PERFORMING THE METHOD, AND RECORDER INCORPORATING THE CLEANING CONTROLLER

BACKGROUND OF THE INVENTION

The present invention relates to a cleaning control method for a recording head incorporated in a recorder which is directly connectable to an information processor such as a personal computer, a digital camera, or the like. The present invention also relates to a cleaning controller performing the method, and a recorder incorporating the cleaning controller.

A related recorder which includes a cleaner for a recording head and performs a cleaning control for the same is provided with a clock utilizing a time generating device such as an RTC or the like. Such a recorder compares time information indicated by the clock and time information stored in a nonvolatile storage medium etc. which indicates the latest time at which the recording or the cleaning operation is performed, in order to determine whether the further cleaning operation is needed. The recorder is also provided with a battery to supply power to the clock in order to maintain the clock function even when a power source of the recorder is turned off. However, since the recorder must be provided with the clock and the battery, there arises a problem that the cost of the recorder is increased.

Japanese Patent Publication No. 11-192728A discloses a recorder which acquires time information from an external device such as an information processing unit connected to the recorder, and clocks up through use of a software program utilizing the acquired time information. This recorder does not require the clock and the battery therein so that the above problem has been solved.

Specifically, the recorder is provided with: a receiver which receives time information from the external device when the recorder is activated, or prior to the first recording after the activation of the recorder; an information processor which clocks from an initial value set as time indicated by the received time information, by executing clock processing defined by the software program; and a determinant which determines whether the cleaning operation is needed, based on the time clocked by the information processor.

More specifically, the information processor includes a timer so called a software timer. The timer sets the time information acquired from the external device as the initial value, and performs interruption processing of the software program at each predetermined period while counting the number of the interruption processing performed. Present time information is obtained by adding a value, which is multiplication of the period of the interruption processing and the counted number of interruption processing performed, to the initial value. The obtained present time information is compared with time information stored in a nonvolatile storage medium etc. which indicates the latest time at which the recording or the cleaning operation is performed, in order to determine whether the further cleaning operation is needed.

However, in the related art, the time information received from the external device and the time information stored in the nonvolatile storage medium etc., which indicates the latest time at which the recording or the cleaning operation is performed, a current time, etc., must be provided with all of second, minute, hour, date, month, and A.D. year Then, this is accompanied by the requirement that the RAM in which the time information is stored or the storage medium such as the nonvolatile storage medium etc. is large in capacity.

SUMMARY OF THE INVENTION

It is therefore an object of the present invention to provide a low-cost head cleaning controller and a recorder incorporating the controller in which the capacity of a storage medium required by a timer is made small.

In order to achieve the above object, according to the present invention, there is provided a cleaning controller for a recording head of a recorder connected to an external device, comprising:

- a timer, which acquires a first time value indicating a current time from the external device, and performs cyclic clocking in which a first predetermined time period is repetitively clocked from a predetermined time point;
- a nonvolatile storage medium, which stores a second time value indicating a time at which a cleaning operation is lastly performed;
- a determinant, which compares the first and the second time values to obtain a third time value, and determines whether a cleaning operation is necessary to be performed based on the third time value; and
- a cleaner, which performs a cleaning operation of the recording head based on the result determined by the determinant.

In this configuration, the timer does not clock the time information including all of second, minute, hour, date, month, and A.D. year, but clocks a time with required minimum time information e.g. with the time information by the hour. Accordingly, a smaller capacity than in the related art suffices for the storage capacity which is required for the storage medium to store the time information. This arrangement enables provision of the low-cost recording head cleaning controller having the storage medium made small in capacity.

Preferably, the third time value is obtained by subtracting the second time value from the first time value. The determinant compares the third time value with a fourth time value which is obtained by subtracting a second predetermined time period from the first predetermined time period of the cyclic clocking, when the third time value is not a negative value. The determinant determines that the time indicated by the first time value is earlier than the time indicated by the second time value, when the third time value is greater than the fourth time value. The determinant determines that the third time value is an elapsed time period from the time indicated by the second time value, when the third time value is not greater than the fourth time value.

In this configuration, for example, even in case the cleaning controller is coupled to the external device such as a personal computer etc. for transmitting time information is replaced with another external device, whereby the time indicated by the first time value received from this another external device comes to have an earlier time than the time indicated by the second time value, the requirement of the cleaning operation can be determined accurately.

On the other hand, the determinant compares the third time value with a fifth time value which is obtained by adding the third time value to the first predetermined time period of the cyclic clocking, when the third time value is a negative value. The determinant determines that the time indicated by the first time value is earlier than the time indicated by the second time value, when the third time value is greater than the fifth time value. The determinant determines that the third time value is an elapsed time period from the time indicated by the second time value, when the third time value is not greater than the fifth time value.

In this configuration, for example, even if the time indicated by the first time value and the time indicated by the second time value stand in the time relation such as to stride over the predetermined time point in the cyclic clocking, the requirement of the cleaning operation can be determined accurately.

Preferably, the cleaning controller further comprises a power-off time recorder, which records a sixth time value on the nonvolatile storage medium, the sixth time value indicating a time at which the recorder is deactivated. The timer uses the sixth time value as the predetermined time point, when the recorder is activated. The timer uses the first time value as the predetermined time point, when the timer acquires the fist time value after the recorder is activated.

Upon activation of the recorder, because not including a clock, the recorder cannot clock a time until the time information is acquired from the external device. However, in this configuration, since the power-off time (the sixth time value) is stored in the nonvolatile storage medium, and upon activation, a time is clocked from the power-off time, time clocking can be enabled even during the time period after the activation of the recorder until first time value is acquired from the external device. The time clocked hereupon does not include the time period during the deactivation of the recorder, but even in case time information is not inputted from the external device immediately after the activation of the recorder, time clocking is made possible, thus enabling execution of the cleaning operation.

Preferably, the predetermined time point is zero o'clock of January 1st, and the first predetermined time period is 4 years including a leap year.

In this configuration, accurate time clocking is made possible even in a leap year, and the requirement of the cleaning operation can be determined accurately.

Here, it is preferable that the second predetermined time period is 24 hours.

According to the present invention, there is also provided a cleaning controller for a recording head of a recorder connected to an external device and including an ink system to which an ink cartridge provided with a nonvolatile storage medium is detachably attached, comprising:

a timer, which acquires a first time value indicating a current time from the external device, and performs cyclic clocking in which a first predetermined time period is repetitively clocked from a predetermined time point;

a power-off time recorder, which records a second time value on the nonvolatile storage medium, the second time value indicating a time at which the recorder is deactivated;

a determinant, which compares the first and the second time values to determine whether a cleaning operation is necessary to be performed; and a cleaner, which performs a cleaning operation of the recording head based on the result determined by the determinant, wherein the predetermined time point is zero o'clock of January 1st, and the first predetermined time period is 4 years including a leap year;

wherein the timer uses the second time value as the predetermined time point, when the recorder is activated; and wherein the timer uses the second time value as the predetermined time point, when the timer acquires the fist time value after the recorder is activated.

In this configuration, in addition to the above described advantages, since the second time value is stored in the nonvolatile storage medium provided with the ink cartridge, there is no need for providing the nonvolatile storage medium in the recorder. Accordingly, thereby, the cost of the recorder can be reduced.

According to the present invention, there is also provided a recorder, which incorporates the above cleaning controllers.

According to the present invention, there is also provided a method of controlling a cleaning operation for a recording head of a recorder connected to an external device, comprising the steps of:

acquiring a first time value indicating a current time from the external device;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step.

Preferably, the third time value is obtained by subtracting the second time value from the first time value. The third time value is compared with a fourth time value which is obtained by subtracting a second predetermined time period from the first predetermined time period of the cyclic clocking, when the third time value is not a negative value. It is determined that the time indicated by the first time value is earlier than the time indicated by the second time value, when the third time value is greater than the fourth time value. It is determined that the third time value is an elapsed time period from the time indicated by the second time value, when the third time value is not greater than the fourth time value.

Here, it is preferable that the third time value is compared with a fifth time value which is obtained by adding the third time value to the first predetermined time period of the cyclic clocking, when the third time value is a negative value. It is determined that the time indicated by the first time value is earlier than the time indicated by the second time value, when the third time value is greater than the fifth time value. It is determined that the third time value is an elapsed time period from the time indicated by the second time value, when the third time value is not greater than the fifth time value.

Preferably, the cleaning control method further comprises the step of recording a sixth time value on the nonvolatile storage medium, the sixth time value indicating a time at which the recorder is deactivated. The sixth time value is used as the predetermined time point, when the recorder is activated. The first time value is used as the predetermined time point, when the timer acquires the fist time value after the recorder is activated.

Preferably, the predetermined time point is zero o'clock of January 1st, and the first predetermined time period is 4 years including a leap year.

Here, it is preferable that the second predetermined time period is 24 hours.

According to the present invention, there is also provided a method of controlling a cleaning operation for a recording head of a recorder connected to an external device and including an ink system to which an ink cartridge provided with a nonvolatile storage medium is detachably attached, comprising the steps of:

acquiring a first time value indicating a current time from the external device;

performing cyclic clocking in which a first predetermined time period is repetitively clocked from a predetermined time point;

recording a second time value on the nonvolatile storage medium, the second time value indicating a time at which the recorder is deactivated;

comparing the first and the second time values to determine whether the cleaning operation is necessary to be performed; and performing the cleaning operation of the recording head based on the result determined by the determinant, wherein the predetermined time point is zero o'clock of January 1st, and the first predetermined time period is 4 years including a leap year;

wherein the second time value is used as the predetermined time point, when the recorder is activated; and wherein the second time value is used as the predetermined time point, when the timer acquires the fist time value after the recorder is activated.

According to the present invention, there is also provided a recording method, which incorporates the above cleaning control methods.

According to the present invention, there is also provided a program for causing a computer to control a cleaning operation for a recording head of a recorder connected to an external device, the program executing the steps of:

acquiring a first time value indicating a current time from the external device;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step.

Preferably, the third time value is obtained by subtracting the second time value from the first time value. The third time value is compared with a fourth time value which is obtained by subtracting a second predetermined time period from the first predetermined time period of the cyclic clocking, when the third time value is not a negative value. It is determined that the time indicated by the first time value is earlier than the time indicated by the second time value, when the third time value is greater than the fourth time value. It is determined that the third time value is an elapsed time period from the time indicated by the second time value, when the third time value is not greater than the fourth time value.

Here, it is preferable that the third time value is compared with a fifth time value which is obtained by adding the third time value to the first predetermined time period of the cyclic clocking, when the third time value is a negative value. It is determined that the time indicated by the first time value is earlier than the time indicated by the second time value, when the third time value is greater than the fifth time value. It is determined that the third time value is an elapsed time period from the time indicated by the second time value, when the third time value is not greater than the fifth time value.

Preferably, the cleaning control method further comprises the step of recording a sixth time value on the nonvolatile storage medium, the sixth time value indicating a time at which the recorder is deactivated. The sixth time value is used as the predetermined time point, when the recorder is activated. The first time value is used as the predetermined time point, when the timer acquires the fist time value after the recorder is activated.

Preferably, the predetermined time point is zero o'clock of January 1st, and the first predetermined time period is 4 years including a leap year.

Here, it is preferable that the second predetermined time period is 24 hours.

According to the present invention, there is also provided a program for causing a computer to control a cleaning operation for a recording head of a recorder connected to an external device and including an ink system to which an ink cartridge provided with a nonvolatile storage medium is detachably attached, the program executing the steps of:

acquiring a first time value indicating a current time from the external device;

performing cyclic clocking in which a first predetermined time period is repetitively clocked from a predetermined time point;

recording a second time value on the nonvolatile storage medium, the second time value indicating a time at which the recorder is deactivated;

comparing the first and the second time values to determine whether the cleaning operation is necessary to be performed; and performing the cleaning operation of the recording head based on the result determined by the determinant, wherein the predetermined time point is zero o'clock of January 1st, and the first predetermined time period is 4 years including a leap year;

wherein the second time value is used as the predetermined time point, when the recorder is activated; and wherein the second time value is used as the predetermined time point, when the timer acquires the fist time value after the recorder is activated.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Preferred embodiments of the invention will hereinafter be described with reference to the accompanying drawings.

Figure 1:
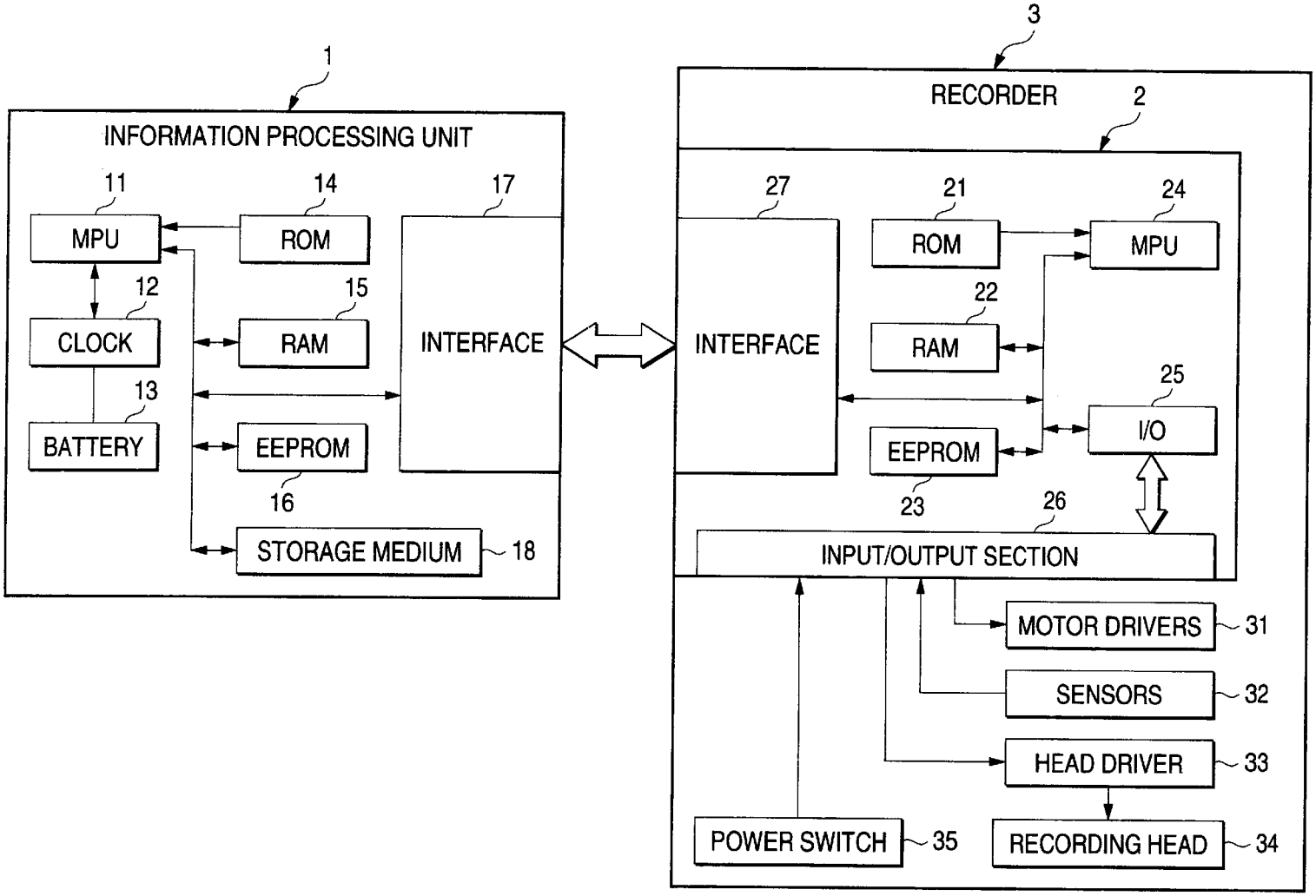
FIG. 1 is a block diagram showing the arrangement in which a recorder according to the invention is coupled to an information processing unit serves as an external device.

FIG. 1 is a block diagram showing the arrangement in which a recorder according to the invention is coupled to an information processing unit serving as an external device. The information processing unit 1 may be a personal computer, a digital image processor, or the like. The calculation processing for a variety of processing is performed in an MPU (Micro Processing Unit) 11, and a software program, predetermined data, etc. are stored in a ROM (Read Only Memory) 14, and an EEPROM (Electrically Erasable and Programmable Read Only Memory) 16 and the recording medium 18, and the temporary data of the MPU 11 under calculation processing is temporarily stored in a RAM (Random Access Memory) 15. Also, a clock 12 is mounted on the information processing unit 1, and the clock 12 is arranged such that a power is supplied from a battery 13 to thereby enable time clocking even while the information processing unit 1 is deactivated. Further, the information processing unit 1, coupled to the recorder 3 via an interface 17 so that various information and data are communicated with the recorder 3.

On the other hand, the recorder 3 may be an ink-jet-type printer or the like, and a recording controller 2 performs the control of a variety of recording processing. In the recording controller 2, the calculation processing for a variety of processing is performed in an MPU 24, a software program, predetermined data, etc. are stored in a ROM 21, and the temporary data under calculation processing, etc., are temporarily stored in a RAM 22. Also, an EEPROM 23, having predetermined data on the calculation processing result in the MPU 24 stored therein, is arranged to retain the predetermined data even while the recorder 3 is powered down. Further, the recording controller 2, coupled to the information processing unit 1 via an interface 27 so that various information and data are communicated with the information processing unit 1.

Then, an I/O 25 performs an output control with respect to various kinds of motor drivers 31 and a head driver 33 via an input/output section 26 based on the calculation processing result in the MPU 24, and inputs via the input/output section 26 the input information from various kinds of sensors 32, the state information of a power switch 35, etc. Further, the various kinds of motor drivers 31 are the drivers for driving a group of motors such a motor for recording paper conveyance, a motor for carriage conveyance, etc., and the head driver 33, coupled to the recording head 34 for performing a recording processing on recording paper, is the driver for performing the control of recording processing with respect to the recording head 34. Also, the various kinds of sensors 32 detect a variety of state information of the recorder 3 and output the detected information to the I/O 25 via the input/output section 26.

Also, the recording controller 2, including no clock, is arranged to input time information in a predetermined procedure from the information processing unit 1, and performs time clocking with the time information as a start point by the software timer which is realized by executing the software program, stored in the ROM 21 of the recording controller 2, by the MPU 24 of the recording controller 2. Since the time data stored in the RAM 22 is lost upon the deactivation of the recorder 3, it is arranged, upon recording execution, that time information is inputted from the information processing unit 1 prior to recording information, the time information is converted into four-year-cycle time data to be stored in the RAM 22, and time clocking is performed with the time data as a start point, thereby enabling attainment of an accurate current time. In this embodiment, the capacity occupied by the time data stored in the RAM 22 is 2 bytes, and this is at least not more than half the capacity of the time data which is clocked by the time including all of second, minute, hour, date, month, and A.D. year in the related art.

This arrangement enables effective use of the limited capacity of the RAM 22 of the recorder, and further enables cost reduction by virtue of the capacity minimization of the RAM 22 of the recorder 3.

Figure 2:
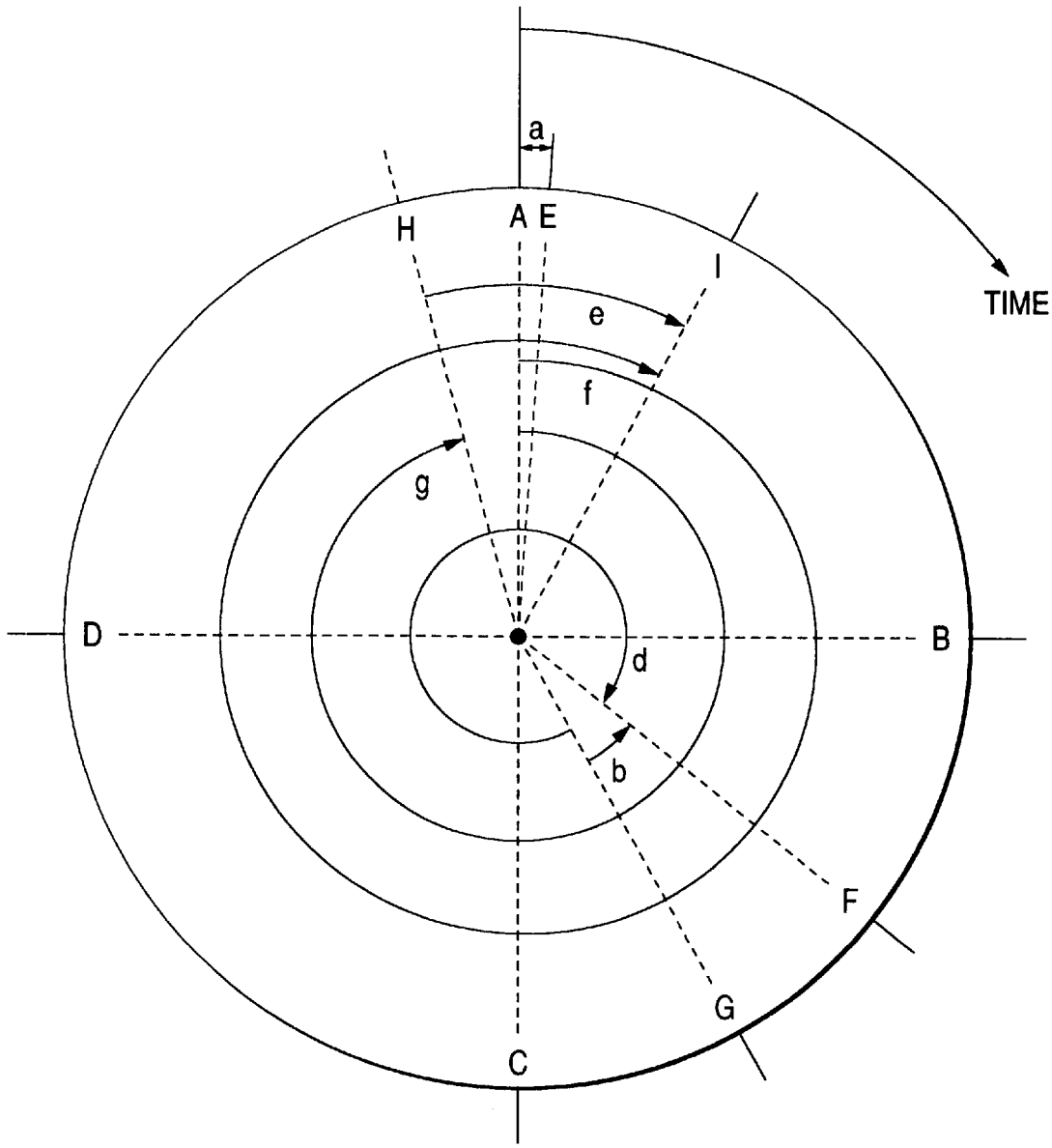
FIG. 2 is a diagram showing the concept of a fixed-cycle timer.

FIG. 2 shows the concept of a fixed-cycle timer in the cleaning controller according to the invention, which will hereinafter be described with reference to FIG. 2. In this embodiment, the fixed-cycle timer sets symbol A as a start point, a first year as a leap year, and four years including a leap year as one cycle. Symbol a showing the time period between symbols A and E indicates a minimum unit in time clocking, which is one hour. Namely, the start point A is set to 00:00 first of January in a leap year, and 00:00 first of January in year 0000 to 23:00 thirty-first of December in year 0003 is clocked by the hour, thus repeating the same. Also, symbol B shows 00:00 first of January in year 0001, symbol C 00:00 first of January in year 0002, and symbol D 00:00 first of January in year 0003. $(365\times4+1)\times24$ hours are clocked by the hour from symbol A, and then back to symbol A again, thus repeating the clocking of $(365\times4+1)\times24$ hours.

Figure 4:
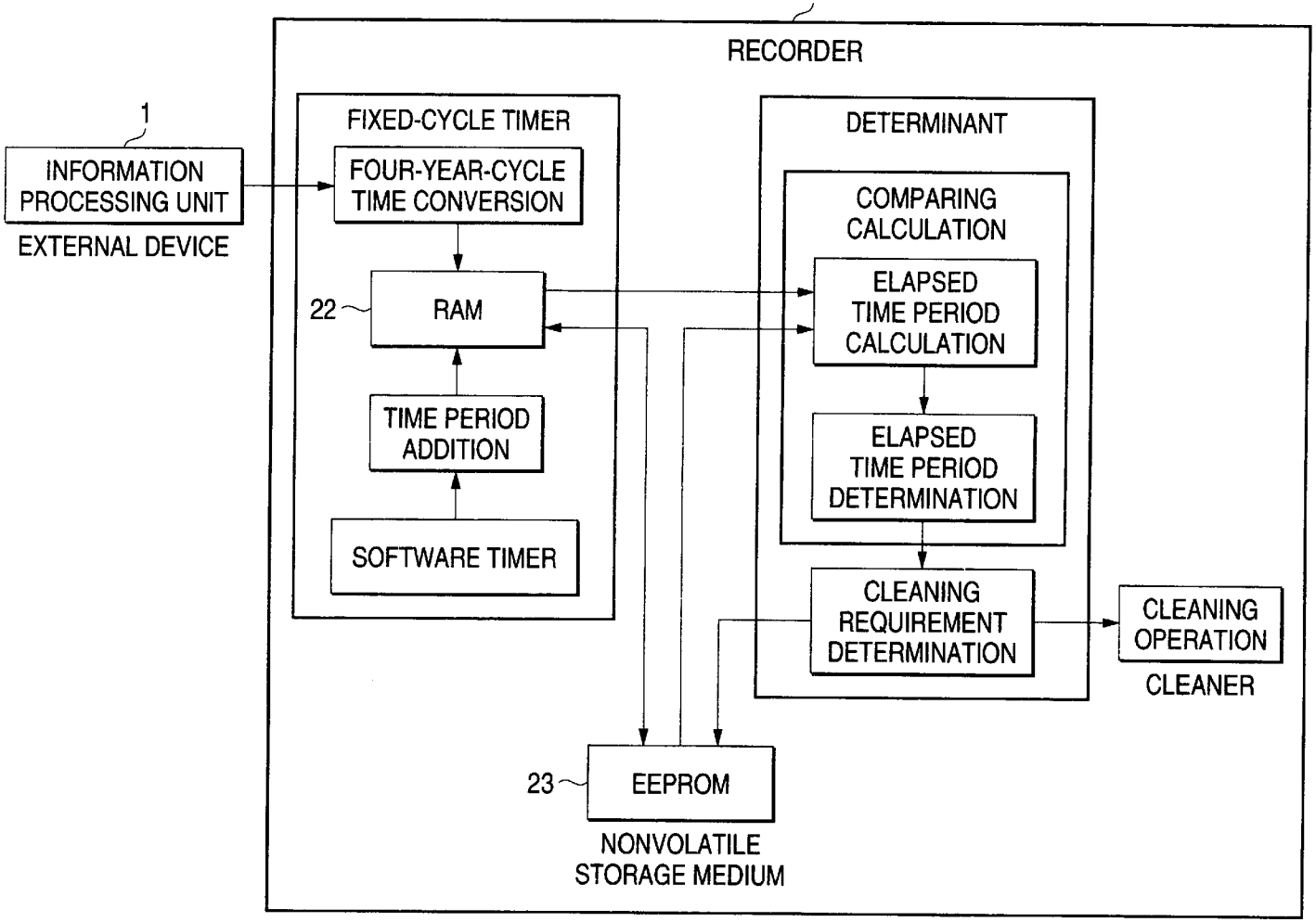
FIG. 4 is a block diagram showing the functional arrangement of a cleaning controller according to a first embodiment of the invention.

FIG. 4 is a block diagram showing the functional arrangement of the cleaning controller according to a first embodiment of the invention.

Time information is outputted from the information processing unit 1 as the external device to the fixed-cycle timer. Further, in this embodiment, the timing with which this time information is outputted is the time when recording is executed in the recorder 3 or the time to demand cleaning control from the information processing unit 1.

The fixed-cycle timer converts this time information into the time by the hour with four years as one cycle (four-year-cycle time conversion) as shown in FIG. 2, and the converted time is stored in the RAM 22. Also, a time period is counted by the software timer, and the counted time period is added to the time which is stored in the RAM 22 each time one hour passes, thus updating the time (time period addition). The latest time of cleaning performed by a cleaner is stored in the EEPROM 23 as the nonvolatile storage medium.

A determinant compares the time stored in the RAM 22 with the latest time of cleaning performed which is stored in the EEPROM 23 (comparing calculation). The determinant calculates the elapsed time period between the latest time of cleaning performed and the current time stored in the RAM 22 (elapsed time period calculation), and determines the elapsed time period (elapsed time period determination). Subsequently, the determinant determines whether the time to need cleaning has come or not based on the latest time of cleaning performed (cleaning requirement determination). Then, when the time to need cleaning has come, cleaning is performed.

Figure 5:
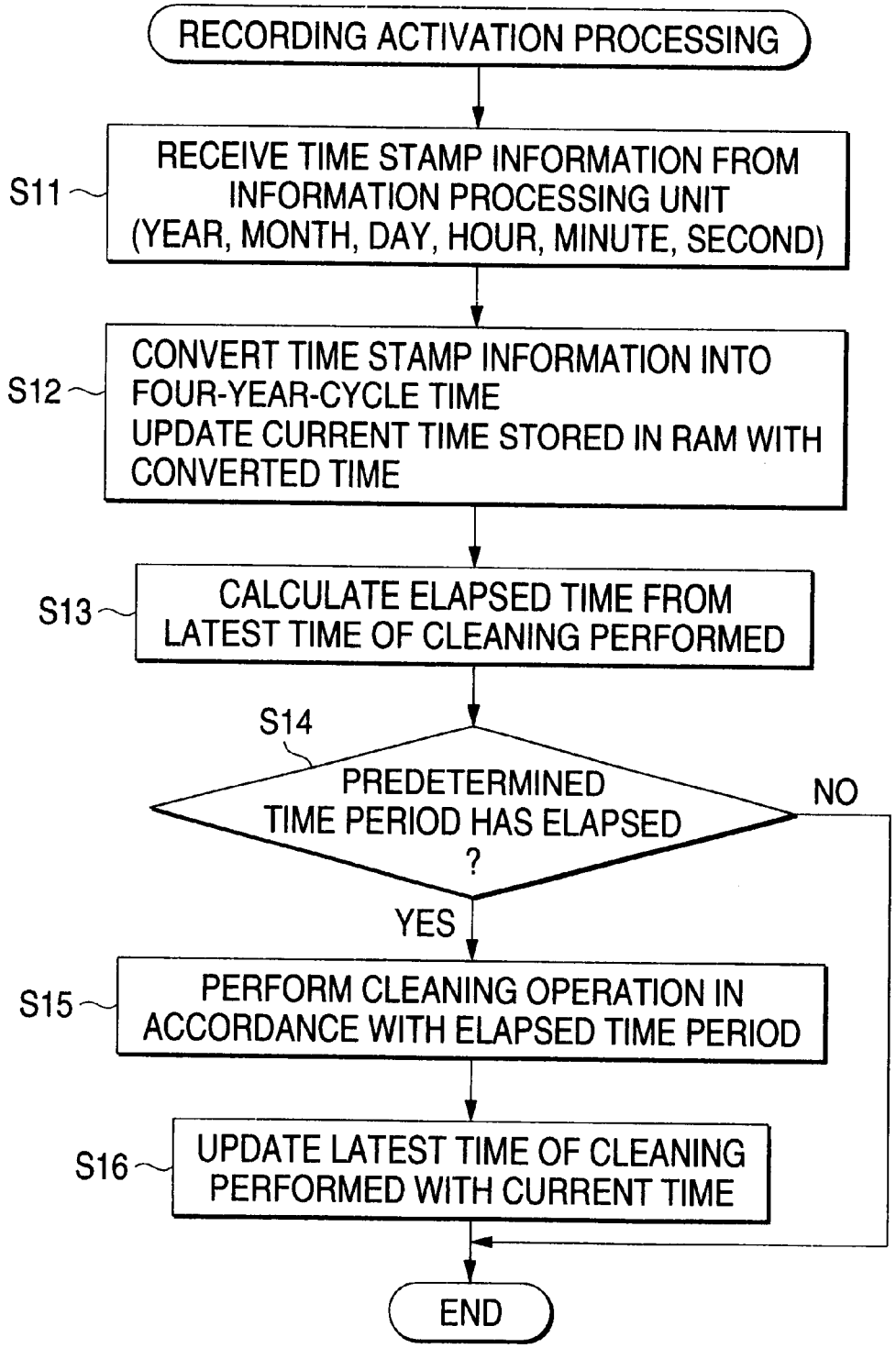
FIG. 5 is a flow chart showing the procedure of a cleaning control method.

FIG. 5 is a flow chart showing the procedure of the cleaning control method according to the invention. The procedure shown by the flow chart in the figure is the procedure which is realized by executing the software program, stored in the ROM 21 of the recording controller 2 (FIG. 1), by the MPU 24 of the recording controller 2, and the procedure which is executed upon start of recording on recording paper.

At the time of start of recording, first, time stamp information as time information is received from the information processing unit 1 prior to recording data (step S11). This time stamp information is the time information being clocked by the clock 12 inside the information processing unit 1, and the time information by second, minute, hour, date, month, and year. Subsequently, the received time stamp information is converted into a four-year-cycle time by the hour, and the current time stored in the RAM 22 is updated with the thus-converted time as a current time (four-year-cycle time conversion, step S12). Subsequently, the elapsed time period from the latest time of cleaning performed is calculated (step S13), thus determining whether or not a predetermined time period or more has elapsed from the latest time of cleaning performed (step S14).

If the predetermined time period or more has not elapsed from the latest time of cleaning performed (No in step S14), the recording activation processing is allowed to finish. If the predetermined time period or more has elapsed from the latest time of cleaning performed (Yes in step S14), the cleaning operation in accordance with the elapsed time period is performed (step S15). Then, the latest time of cleaning performed is updated with a current time (step S16).

Figure 6:
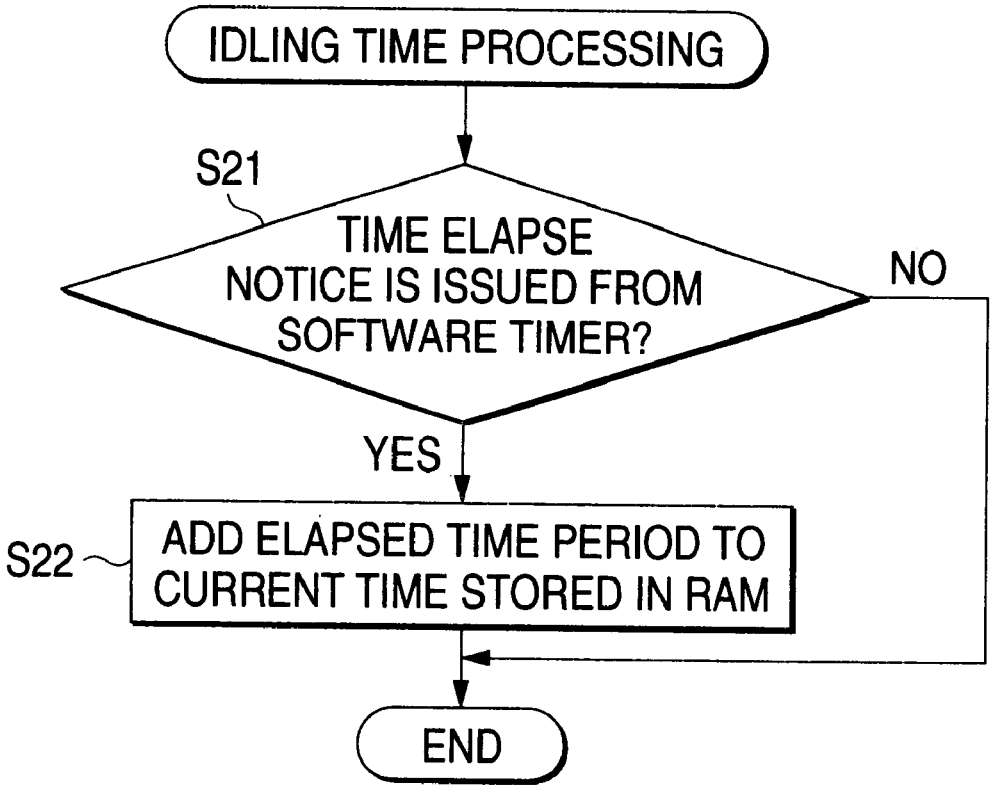
FIG. 6 is a flow chart showing the procedure of time period addition in the fixed-cycle timer.

FIG. 6 is a flow chart showing the procedure corresponding to the hour addition in the fixed-cycle timer. The procedure shown by the flow chart in the figure is the procedure which is realized by executing the software program stored in the ROM 21 of the recording controller 2 (FIG. 1) by the MPU 24 of the recording controller 2, and the procedure for idling time processing which is repeatedly executed under a standby state in which recording is not executed in the activation state of the recorder 3.

The software timer inside the recorder 3, during the activation of the recorder 3, continues to count hours at all times and continues to issue a time elapse notice every hour. Whether this time elapse notice is issued or not during the idling time processing is judged (step S21), and if the time elapse notice is not issued (No in step S21), the idling time processing is allowed to finish. On the other hand, if the time elapse notice is issued (Yes in step S21), the elapsed time period (one hour) is added to the time stored in the RAM 22, thus updating the time information (step S22).

Figure 3:
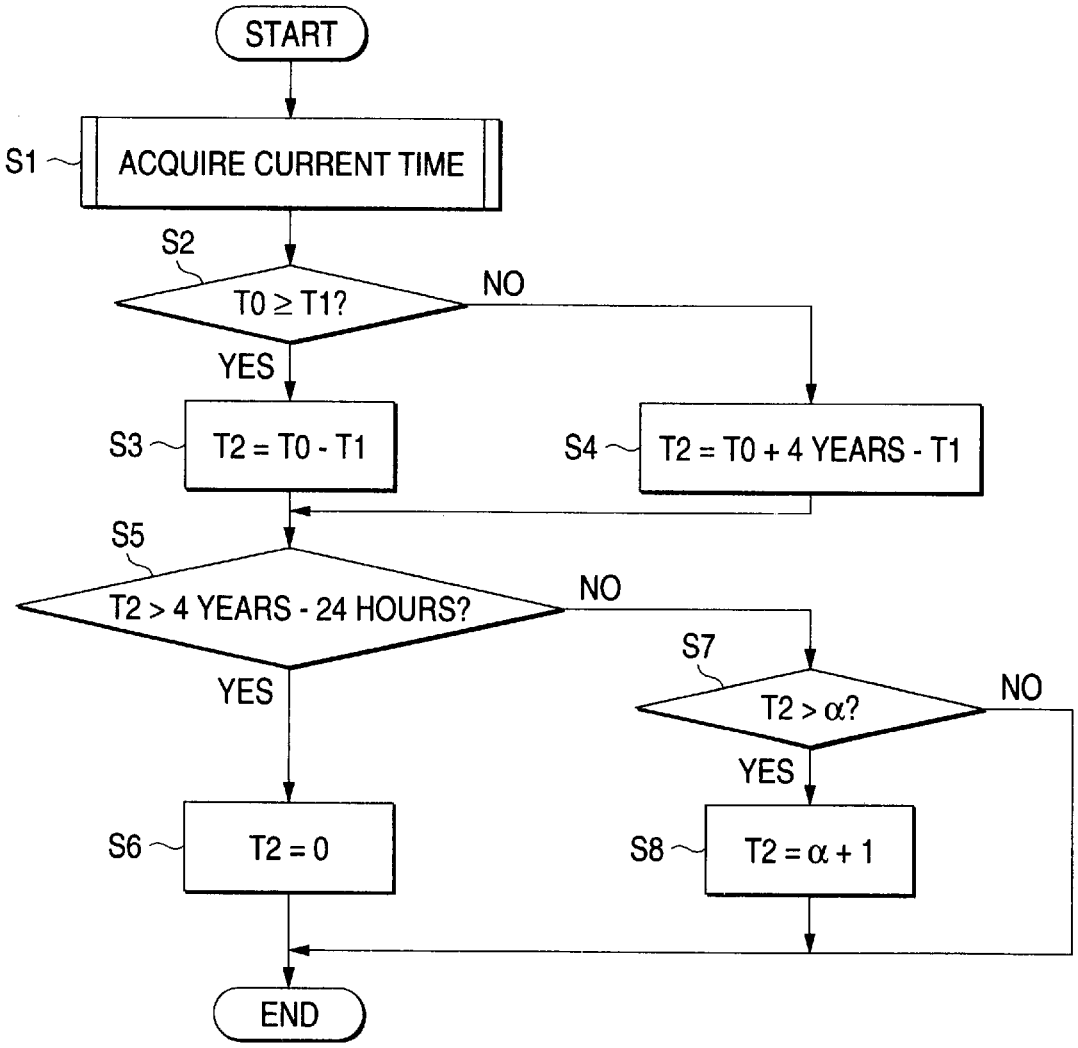
FIG. 3 is a flow chart showing the procedure for determining whether a cleaning operation is needed.

FIG. 3 is a flow chart showing the procedure of determining whether a cleaning is needed or not. The procedure shown in this flow chart serves as the determinant including the comparing calculation and the cleaning requirement determination shown in FIG. 4. Also, the procedure shown in this flow chart is the procedure which is realized by executing the software program, stored in the ROM 21 of the recording controller 2 (FIG. 1), by the MPU 24 of the recording controller 2, and is executed in every cycle in a predetermined cycle or when a predetermined execution requirement is satisfied.

First, the recording controller 2 acquires the current time T0 stored in the RAM 22 (step S1). Subsequently, a value obtained by subtracting a designated time T1 from the current time T0 is found in order to compare the acquired current time T0 with the designated time T1 (step S2). Here, the designated time T1 indicates the latest time of cleaning performed which is stored in the EEPROM 23 as the nonvolatile storage medium, and is updated each time cleaning operation is performed.

In case the current time T0 is on and after the designated time T1 namely, in case the value found in step S2 is 0 or more (Yes in step S2), the designated time T1 is subtracted from the current time T0, thus finding the elapsed time period T2 by the hour (step S3). Subsequently, the elapsed time period T2 found is compared with a predetermined value obtained by subtracting 24 hours from 4 years (step S5).

The aforesaid predetermined value will now be described also with reference to FIG. 2. Symbol F of FIG. 2 indicates the current time and symbol G indicates the designated time. There is shown the case in which the current time F is an earlier time than the designated time G as the latest time of cleaning performed. This corresponds to the going backward of time as shown by the arrow of symbol b of FIG. 2. Actually, the current time F cannot be an earlier time than the designated time G as the latest time of cleaning performed. However, such a phenomenon can occur, for example, in case a time of the clock in the information processing unit 1 is corrected and delayed, the information processing unit 1 is replaced with another information processing unit so that the clock in this another information processing unit loses more time than the clock in the information processing unit 1, etc. In such a case, since the elapsed time period becomes the elapsed time period passing as shown by the arrow of symbol d in the fixed-cycle timer, it is misidentified as if there elapsed the time period which actually has not elapsed, thus resulting in execution of an unnecessary cleaning.

In step S5 of FIG. 3, the elapsed time period is compared with the value of (4 years−24 hours) as the predetermined time period, which means that whether or not the elapsed time period is the value in the range of minus 24 hours to zero hours is determined. Namely, it means that there is determined whether or not the current time F has become an earlier time in the range of zero to 24 hours than the designated time G as the latest time of cleaning performed. Step S5 is the procedure in which in case the elapsed time period is in the range of these hours, it is regarded for example as the case in which a time of the clock in the information processing unit 1 is corrected and delayed, the information processing unit 1 is replaced with another information processing unit so that the clock in this another information processing unit loses more time than the clock in the information processing unit 1, etc., thus determining that the elapsed time period is zero hours.

Namely, step S5 of FIG. 3 is the procedure for detecting the phenomenon, occurring due to the aforesaid factors, such that the current time F is an earlier time than the designated time G as the latest time of cleaning performed, and preventing a possibility that the time period which actually has not elapsed is misidentified as if it elapsed, resulting in execution of an unnecessary cleaning operation. Then, a value of "minus 24 hours" out of the predetermined value (4 years−24 hours) is the time period which is very small in the amount of time period backed due to the aforesaid factors, and in most cases, is the value of permissible time period defined by being assumed to be within this predetermined time period.

If the elapsed time period found T2 is longer than the predetermined value (Yes in step S5), it is regarded for example as the going backward of time due to the case in which a time of the clock in the information processing unit 1 is corrected and delayed, the information processing unit 1 is replaced with another information processing unit so that the clock in this another information processing unit loses more time than the clock in the information processing unit 1, etc., thus processing with the elapsed time period T2 as zero hours (step S6). Also, if the elapsed time period T2 is not longer than the predetermined value (No in step S5), the elapsed time period T2 is compared with the cleaning requirement time period a which is the value of the elapsed time period which has elapsed by the time the recording head requires cleaning, thus determining whether or not the time period has elapsed by the time cleaning is needed. Further, the cleaning requirement time period $\alpha$ is the value determined by each characteristic of the recording head 34.

In case the value of the elapsed time period T2 is not greater than the cleaning requirement time period $\alpha$ (No in step S7), the elapsed time period T2 is stored in a predetermined area of the RAM 22. In case the value of the elapsed time period is greater than the cleaning requirement time period $\alpha$ (Yes in step S7), the elapsed time period T2 is set to a value of $\alpha+1$ (step S8) and stored in the predetermined area of the RAM 22. Then, the cleaning control is performed with respect to the cleaner (FIG. 4).

On the other hand, if the current time T0 is an earlier time than the designated time T1, namely, in case the value found in step S2 is a negative value (No in step S2), the value of 4 years as one-cycle period in the aforesaid time clocking method is added to the value obtained by subtracting the current time T0 from the designated time T1, thus finding the elapsed time period T2 by the hour (step S4).

The procedure for finding the elapsed time period in step S4 will now be described also with reference to FIG. 2. Symbol H of FIG. 2 indicates the designated time as the latest time of cleaning performed and symbol I indicates the current time. The start point A in the fixed-cycle timer is placed between the designated time H and the current time I. Namely, the designated time H and the current time I stand in the time relation such as to stride over the start point A. Also, in this embodiment, the fixed-cycle timer repeatedly performs the time clock processing with 4 years from the start point A as one cycle. Accordingly, in such a case, although the designated time H and the current time I are in the time relation in which a time period has elapsed as shown by the arrow of symbol e of FIG. 2, the value obtained by subtracting the designated time from the current time becomes a negative value.

If the designated time and the current time stand in the time relation such as to stride over the start point A in the fixed-cycle timer as described above, the elapsed time period from the designated time to the current time can be obtained by subtracting the designated time from the time obtained by adding the value of one-cycle period (4 years) in the fixed-cycle timer to the current time. In FIG. 2, the time obtained by adding the value of one-cycle period in the fixed-cycle timer to the current time is indicated by the arrow of symbol f, and the time indicated by the arrow of symbol g as the designated time H is subtracted from the thus-obtained time, thereby obtaining the elapsed time period indicated by the arrow of symbol e.

Namely, this shows that in case the value obtained by subtracting the designated time from the current time is a negative value, the value obtained by adding the value of one-cycle period in the fixed-cycle timer to the negative value obtained by the subtraction becomes the elapsed time period, and step S4 is the procedure for finding the elapsed time period in case the designated time and the current time stand in the time relation such as to stride over the start point in the fixed-cycle timer.

Then, the elapsed time period found T2 is compared with the predetermined time period in the aforesaid step S5 of FIG. 3, thus determining whether cleaning is needed or not in the same procedure as described above.

Thus, the cleaning control shown in this embodiment, while determining accurately whether cleaning is needed or not, enables minimization in the capacity of the nonvolatile storage medium provided in the recorder, thereby realizing the cost reduction for the recorder.

Figure 7:
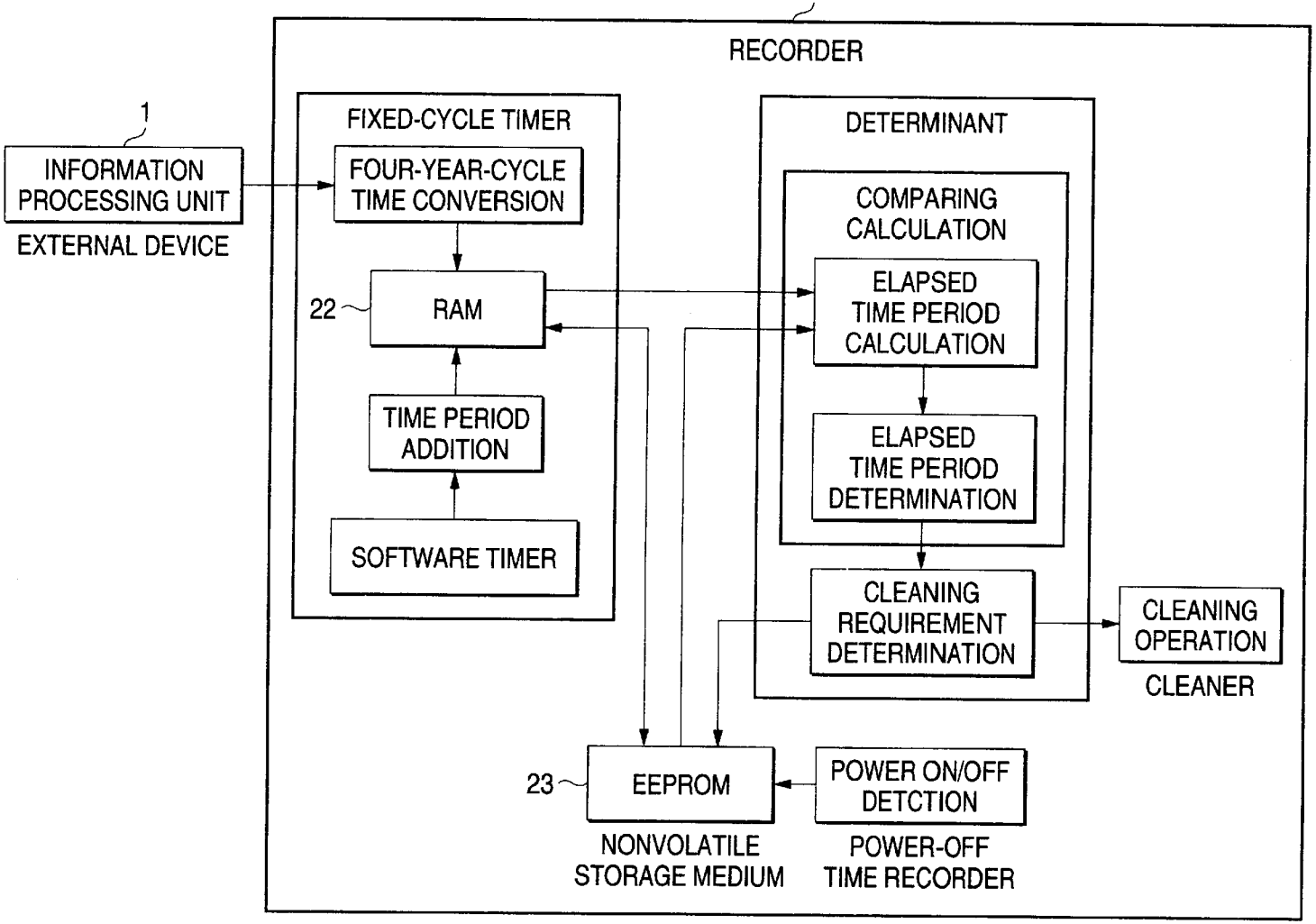
FIG. 7 is a block diagram showing the functional arrangement of a cleaning controller according to a second embodiment of the invention.

FIG. 7 is a block diagram showing the functional arrangement of a cleaning controller according to a second embodiment of the invention. Descriptions for the same portions as those in FIG. 4 will be omitted.

Here, in addition to the first embodiment, the deactivation of the recorder 3 is detected by inputting the state of the power switch 35 of the recorder 3, the deactivated time is recorded in the EEPROM 23 as the nonvolatile storage medium, and upon activation of the recorder 3, a time is clocked starting at the power-off time.

In this embodiment, upon the deactivation of the recorder 3, the time stored in the RAM22 is recorded in the EEPROM 23 by the power switch on/off detection of the recorder 3 performed by the power-off time recorder. Then, upon activation of the recorder 3, the time stored in the EEPROM 23 is stored in the RAM 22.

Figure 8:
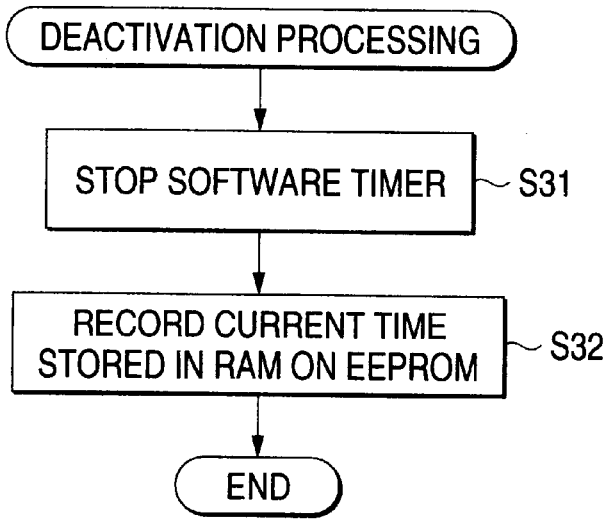
FIG. 8 is a flow chart showing the procedure executed by a power-off time recorder in the cleaning controller of FIG. 7 when the recorder is deactivated.

FIG. 8 is a flow chart showing the procedure upon deactivation of the recorder 3, which is performed by the power-off time recorder shown in FIG. 7.

When the power switch of the recorder 3 is turned off, the software timer inside the recorder 3 is stopped (step S31). Then, the current time stored in the RAM 22 is recorded in the EEPROM 23 as the power-off time (step S 32).

Figure 9:
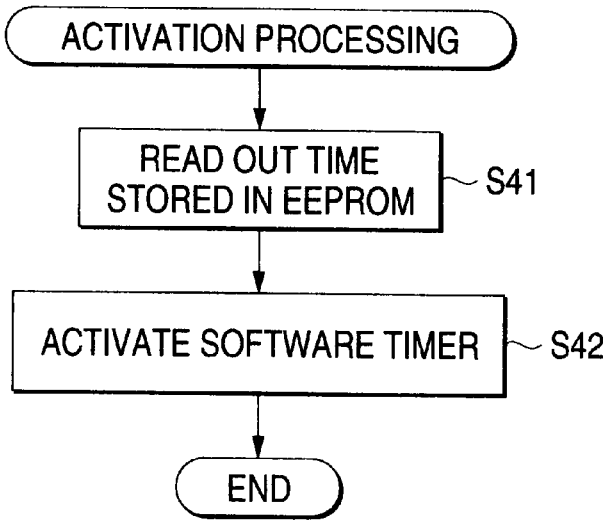
FIG. 9 is a flow chart showing the procedure executed by a power-off time recorder in the cleaning controller of FIG. 7 when the recorder is activated.

FIG. 9 is a flow chart showing the procedure upon activation of the recorder 3, which is performed by the power-off time recorder shown in FIG. 7 similarly to the flow chart shown in FIG. 8.

When the recorder 3 is activated, the power-off time of the recorder 3 stored in the EEPROM 23 is stored as the current time in the RAM 22 (step S41). Then, the software timer inside the recorder 3 is activated to start clocking (step S42).

Thus, during the time period until time information is inputted from the information processing unit 1 after the deactivation, the recorder 3 performs time clocking starting at the power-off time stored in the EEPROM 23 as the nonvolatile storage medium. Accordingly, it becomes possible to clock a time even during the time period until the time information is inputted from the information processing unit 1 after the activation of the recorder 3. The time clocked hereupon does not include the time period during the deactivation of the recorder 3. However, the time clocking during that time period can be made to perform the cleaning operation even in a case where the recording is not executed for a long time after activation of the recorder 3 due to reason that the information processing unit 1 is not coupled to the recorder 3 upon activation of the recorder 3, or the time information is outputted prior to the recording only when the recording operation is executed by the information processing unit 1 side.

Figure 10:
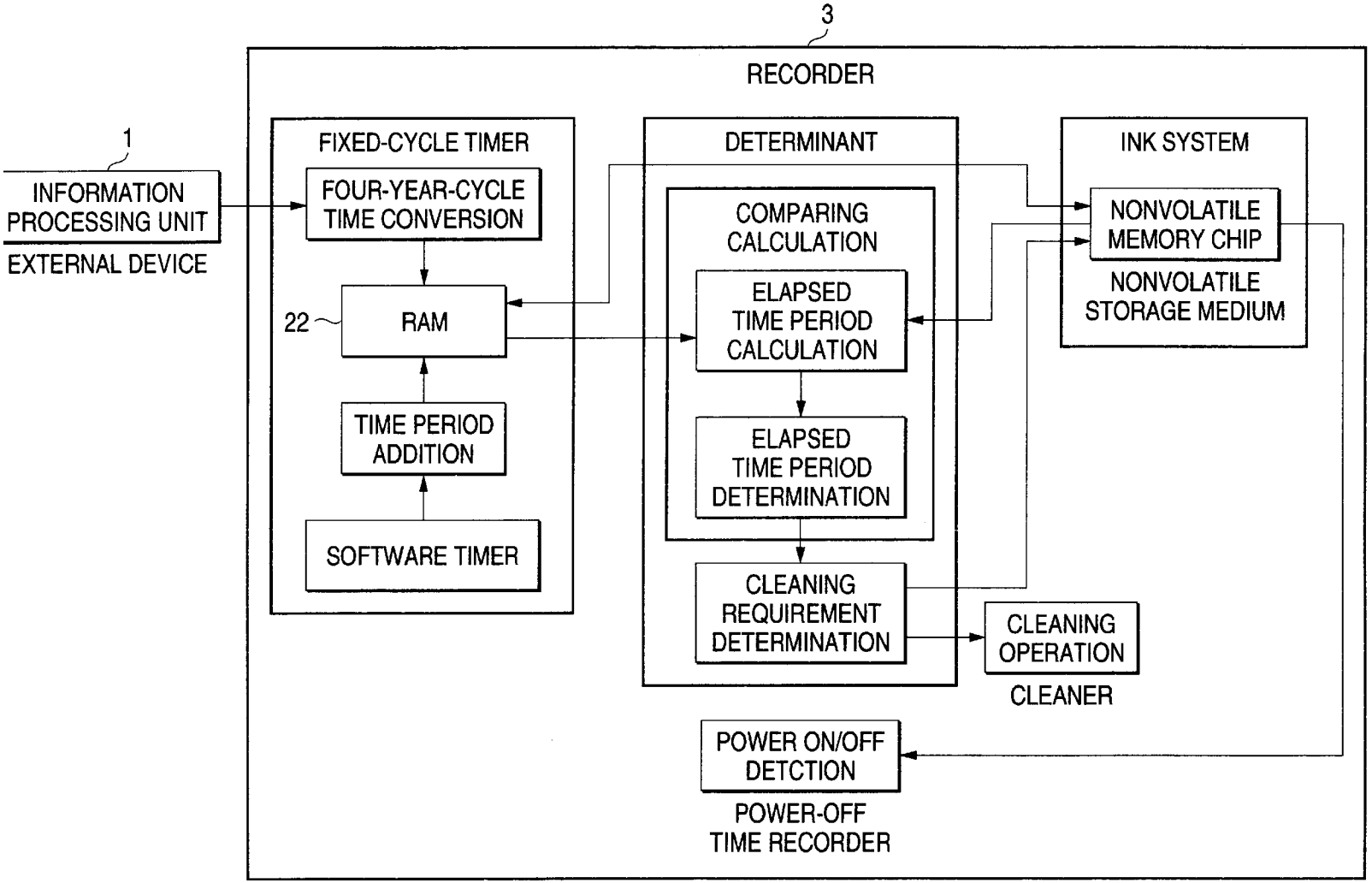
FIG. 10 is a block diagram showing the functional arrangement of a cleaning controller according to a third embodiment of the invention.

FIG. 10 is a block diagram showing the functional arrangement of a cleaning controller according to a third embodiment of the invention. Descriptions for the same portions as those in FIGS. 4 and 7 will be omitted.

In this embodiment, the EEPROM 23 is not provided inside the recorder 3, the latest time of cleaning performed is stored in a nonvolatile memory chip provided with an ink cartridge which is detachably provided with respect to an ink system.

In this embodiment, the ink system (all portions not shown) may include the recording head for ejecting ink onto recording paper, a carriage on which the recording head is mounted, the ink cartridge being filled with each ink, the head driver, the recording controller, etc. The latest time of the cleaning operation performed by the cleaner, as well as a variety of data such as the date/month/year of manufacture of the ink cartridge, is stored in the nonvolatile memory chip. Also, upon the deactivation of the recorder 3, the time stored in the RAM 22 is recorded in the nonvolatile memory chip by the power on/off detection performed by the power-off time recorder. Then, upon activation of the recorder 3, the time stored in the nonvolatile memory chip is stored in the RAM 22.

Thus, since there is no need for the EEPROM 23 to be provided in the recorder 3, the cost of the recorder 3 can be reduced.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, the processing shown in the flow chart of each of FIGS. 3, 5, 6, 8, and 9 can be realized by the hardware circuitry provided in the recorder 3, and in case the processing is constituted by a software program, the software program can also be recorded in the recording medium such as a floppy disk, a CD-ROM, etc. Then, the recorder 3 or the information processing unit 1 can read out the program recorded in this recording medium by a floppy disk drive, a CD-ROM drive, etc. and execute the processing.

Further, in case the processing shown in the flow chart of FIG. 3 is constituted by a software program, this software program can also be recorded in the storage medium 18 mounted on the information processing unit 1. Then, the information processing unit 1 can read out the program recorded in the storage medium 18 and execute the processing.

The invention can be embodied with the aforesaid fixed-cycle timer not applied only to 4 years as one-cycle time period but also to a predetermined time period. The unit of time for use in clocking is not limited to the units of one hour, and the predetermined value of (4 years−24 hours) can also be varied.

What is claimed is:

1. A cleaning controller for a recording head of a recorder connected to an external device, comprising:

a timer, which acquires data indicating a current time from the external device, converts the acquired data into a first value having a data amount smaller than the acquired data, and performs cyclic clocking in which a first predetermined time period is repetitively clocked from a predetermined time point;

a nonvolatile storage medium, which stores a second time value indicating a time at which a cleaning operation is lastly performed;

a determinant, which compares the first and the second time values to obtain a third time value, and determines whether a cleaning operation is necessary to be performed based on the third time value; and a cleaner, which performs a cleaning operation of the recording head based on the result determined by the determinant.

2. The cleaning controller as set forth in claim 1, wherein the third time value is obtained by subtracting the second time value from the first time value;

wherein the determinant compares the third time value with a fifth time value which is obtained by adding the third time value to the first predetermined time period of the cyclic clocking, when the third time value is a negative value;

wherein the determinant determines that the time indicated by the first time value is earlier than the time indicated by the second time value, when the third time value is greater than the fifth time value; and wherein the determinant determines that the third time value is an elapsed time period from the time indicated by the second time value, when the third time value is not greater than the fifth time value.

3. The cleaning controller as set forth in claim 1, further comprising a power-off time recorder, which records a sixth time value on the nonvolatile storage medium, the sixth time value indicating a time at which the recorder is deactivated, wherein the timer uses the sixth time value as the predetermined time point, when the recorder is activated; and wherein the timer uses the first time value as the predetermined time point, when the timer acquires the fist time value after the recorder is activated.

4. The cleaning controller of claim 1, wherein the nonvolatile storage medium is in a memory chip provided in an ink cartridge, which is detachably provided on the recorder.

5. A cleaning controller for a recording head of a recorder connected to an external device, comprising:

a timer, which acquires a first time value indicating a current time from the external device, and performs cyclic clocking in which a first predetermined time period is repetitively clocked from a predetermined time point;

a nonvolatile storage medium, which stores a second time value indicating a time at which a cleaning operation is lastly performed;

a determinant, which compares the first and the second time values to obtain a third time value, and determines whether a cleaning operation is necessary to be performed based on the third time value; and a cleaner, which performs a cleaning operation of the recording head based on the result determined by the determinant, wherein the third time value is obtained by subtracting the second time value from the first time value;

wherein the determinant compares the third time value with a fourth time value which is obtained by subtracting a second predetermined time period from the first predetermined time period of the cyclic clocking, when the third time value is not a negative value;

wherein the determinant determines that the time indicated by the first time value is earlier than the time indicated by the second time value, when the third time value is greater than the fourth time value; and wherein the determinant determines that the third time value is an elapsed time period from the time indicated by the second time value, when the third time value is not greater than the fourth time value.

6. The cleaning controller as set forth in claim 5, wherein the determinant compares the third time value with a fifth time value which is obtained by adding the third time value to the first predetermined time period of the cyclic clocking, when the third time value is a negative value;

wherein the determinant determines that the time indicated by the first time value is earlier than the time indicated by the second time value, when the third time value is greater than the fifth time value; and wherein the determinant determines that the third time value is an elapsed time period from the time indicated by the second time value, when the third time value is not greater than the fifth time value.

7. The cleaning controller as set forth in claim 5, wherein the predetermined time point is zero o'clock of January 1st, and the first predetermined time period is 4 years including a leap year.

8. The cleaning controller as set forth in claim 6, wherein the second predetermined time period is 24 hours.

9. A recorder, which incorporates the cleaning controller as set forth in claim 1 or 5.

10. A cleaning controller for a recording head of a recorder connected to an external device and including an ink system to which an ink cartridge provided with a nonvolatile storage medium is detachably attached, comprising:

a timer, which acquires a first time value indicating a current time from the external device, and performs cyclic clocking in which a first predetermined time period is repetitively clocked from a predetermined time point;

a power-off time recorder, which records a second time value on the nonvolatile storage medium, the second time value indicating a time at which the recorder is deactivated;

a determinant, which compares the first and the second time values to determine whether a cleaning operation is necessary to be performed; and a cleaner, which performs a cleaning operation of the recording head based on the result determined by the determinant, wherein the predetermined time point is zero o'clock of January 1st, and the first predetermined time period is 4 years including a leap year;

wherein the timer uses the second time value as the predetermined time point, when the recorder is activated; and wherein the timer uses the second time value as the predetermined time point, when the timer acquires the fist time value after the recorder is activated.

11. A recorder, which incorporates the cleaning controller as set forth in claim 10.

12. A method of controlling a cleaning operation for a recording head of a recorder connected to an external device, comprising the steps of:

acquiring data indicating a current time from the external device;

converting the acquired data into a first value having a data amount smaller than the acquired data;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step.

13. The cleaning control method as set forth in claim 12, wherein the third time value is obtained by subtracting the second time value from the first time value;

wherein the third time value is compared with a fifth time value which is obtained by adding the third time value to the first predetermined time period of the cyclic clocking, when the third time value is a negative value;

wherein it is determined that the time indicated by the first time value is earlier than the time indicated by the second time value, when the third time value is greater than the fifth time value; and wherein it is determined that the third time value is an elapsed time period from the time indicated by the second time value, when the third time value is not greater than the fifth time value.

14. The cleaning control method as set forth in claim 12, further comprising the step of recording a sixth time value on the nonvolatile storage medium, the sixth time value indicating a time at which the recorder is deactivated, wherein the sixth time value is used as the predetermined time point, when the recorder is activated; and wherein the first time value is used as the predetermined time point, when a timer acquires the first time value after the recorder is activated.

15. A method of controlling a cleaning operation for a recording head of a recorder connected to an external device, comprising the steps of:

acquiring a first time value indicating a current time from the external device;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step, wherein the third time value is obtained by subtracting the second time value from the first time value;

wherein the third time value is compared with a fourth time value which is obtained by subtracting a second predetermined time period from the first predetermined time period of the cyclic clocking, when the third time value is not a negative value;

wherein it is determined that the time indicated by the first time value is earlier than the time indicated by the second time value, when the third time value is greater than the fourth time value; and wherein it is determined that the third time value is an elapsed time period from the time indicated by the second time value, when the third time value is not greater than the fourth time value.

16. The cleaning control method as set forth in claim 15, wherein the third time value is compared with a fifth time value which is obtained by adding the third time value to the first predetermined time period of the cyclic clocking, when the third time value is a negative value;

wherein it is determined that the time indicated by the first time value is earlier than the time indicated by the second time value, when the third time value is greater than the fifth time value; and wherein it is determined that the third time value is an elapsed time period from the time indicated by the second time value, when the third time value is not greater than the fifth time value.

17. The cleaning control method as set forth in claim 15, wherein the predetermined time point is zero o'clock of January 1st, and the first predetermined time period is 4 years including a leap year.

18. The cleaning control method as set forth in claim 17, wherein the second predetermined time period is 24 hours.

19. A recording method, which incorporates the cleaning control method as set forth in claim 12 or 15.

20. A method of controlling a cleaning operation for a recording head of a recorder connected to an external device and including an ink system to which an ink cartridge provided with a nonvolatile storage medium is detachably attached, comprising the steps of:

acquiring a first time value indicating a current time from the external device;

performing cyclic clocking in which a first predetermined time period is repetitively clocked from a predetermined time point;

recording a second time value on the nonvolatile storage medium, the second time value indicating a time at which the recorder is deactivated;

comparing the first and the second time values to determine whether the cleaning operation is necessary to be performed; and performing the cleaning operation of the recording head based on the result determined by the determinant, wherein the predetermined time point is zero o'clock of January 1st, and the first predetermined time period is 4 years including a leap year;

wherein the second time value is used as the predetermined time point, when the recorder is activated; and wherein the second time value is used as the predetermined time point, when the timer acquires the fist time value after the recorder is activated.

21. A recording method, which incorporates the cleaning control method as set forth in claim 20.

22. A program for causing a computer to control a cleaning operation for a recording head of a recorder connected to an external device, the program executing the steps of:

acquiring data indicating a current time from the external device;

converting the acquired data into a first value having a data amount smaller than the acquired data;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step.

23. The cleaning control program as set forth in claim 22, wherein the third time value is obtained by subtracting the second time value from the first time value;

wherein the third time value is compared with a fifth time value which is obtained by adding the third time value to the first predetermined time period of the cyclic clocking, when the third time value is a negative value;

wherein it is determined that the time indicated by the first time value is earlier than the time indicated by the second time value, when the third time value is greater than the fifth time value; and wherein it is determined that the third time value is an elapsed time period from the time indicated by the second time value, when the third time value is not greater than the fifth time value.

24. The cleaning control program as set forth in claim 22, further comprising the step of recording a sixth time value on the nonvolatile storage medium, the sixth time value indicating a time at which the recorder is deactivated, wherein the sixth time value is used as the predetermined time point, when the recorder is activated; and wherein the first time value is used as the predetermined time point, when a timer acquires the first time value after the recorder is activated.

25. A program for causing a computer to control a cleaning operation for a recording head of a recorder connected to an external device, the program executing the steps of:

acquiring a first time value indicating a current time from the external device;

performing cyclic clocking in which a first predetermined time period is repetitively clocked from a predetermined time point;

providing a nonvolatile storage medium, which stores a second time value indicating a time at which the cleaning operation is lastly performed;

comparing the first and the second time values to obtain a third time value;

determining whether the cleaning operation is necessary to be performed based on the third time value; and performing the cleaning operation of the recording head based on the result determined by the determining step, wherein the third time value is obtained by subtracting the second time value from the first time value;

wherein the third time value is compared with a fourth time value which is obtained by subtracting a second predetermined time period from the first predetermined time period of the cyclic clocking, when the third time value is not a negative value;

wherein it is determined that the time indicated by the first time value is earlier than the time indicated by the second time value, when the third time value is greater than the fourth time value; and wherein it is determined that the third time value is an elapsed time period from the time indicated by the second time value, when the third time value is not greater than the fourth time value.

26. The cleaning control program as set forth in claim 25, wherein the third time value is compared with a fifth time value which is obtained by adding the third time value to the first predetermined time period of the cyclic clocking, when the third time value is a negative value;

wherein it is determined that the time indicated by the first time value is earlier than the time indicated by the second time value, when the third time value is greater than the fifth time value; and wherein it is determined that the third time value is an elapsed time period from the time indicated by the second time value, when the third time value is not greater than the fifth time value.

27. The cleaning control program as set forth in claim 25, wherein the predetermined time point is zero o'clock of January 1st, and the first predetermined time period is 4 years including a leap year.

28. The cleaning control program as set forth in claim 27, wherein the second predetermined time period is 24 hours.

29. A program for causing a computer to control a cleaning operation for a recording head of a recorder connected to an external device and including an ink system to which an ink cartridge provided with a nonvolatile storage medium is detachably attached, the program executing the steps of:

acquiring a first time value indicating a current time from the external device;

performing cyclic clocking in which a first predetermined time period is repetitively clocked from a predetermined time point;

recording a second time value on the nonvolatile storage medium, the second time value indicating a time at which the recorder is deactivated;

comparing the first and the second time values to determine whether the cleaning operation is necessary to be performed; and performing the cleaning operation of the recording head based on the result determined by the determinant, wherein the predetermined time point is zero o'clock of January 1st, and the first predetermined time period is 4 years including a leap year;

wherein the second time value is used as the predetermined time point, when the recorder is activated; and wherein the second time value is used as the predetermined time point, when the timer acquires the fist time value after the recorder is activated.

* * * * *